US008277289B2

(12) United States Patent
Pei

(10) Patent No.: US 8,277,289 B2
(45) Date of Patent: Oct. 2, 2012

(54) MULTI-FUNCTIONAL GRINDING APPARATUS

(75) Inventor: Shao-Kai Pei, Tu-Cheng (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 443 days.

(21) Appl. No.: 12/752,153

(22) Filed: Apr. 1, 2010

(65) Prior Publication Data

US 2011/0159792 A1 Jun. 30, 2011

(30) Foreign Application Priority Data

Dec. 28, 2009 (TW) ..... 98145398

(51) Int. Cl.
*B24B 9/00* (2006.01)
*B24B 27/00* (2006.01)

(52) U.S. Cl. ..... 451/180; 451/120; 451/462

(58) Field of Classification Search ..... 451/177, 451/461, 388, 442, 449, 450, 394, 65, 327–329, 451/120, 231, 180, 465, 486, 462
See application file for complete search history.

(56) References Cited

U.S. PATENT DOCUMENTS 5,355,638 A * 10/1994 Hoffman ..... 451/32
5,564,968 A * 10/1996 Werner ..... 451/67
2011/0053472 A1* 3/2011 Pei ..... 451/120
2011/0065367 A1* 3/2011 Pei ..... 451/233

* cited by examiner

*Primary Examiner* — Dung Van Nguyen
(74) *Attorney, Agent, or Firm* — Altis Law Group, Inc.

(57) ABSTRACT

A multi-functional grinding apparatus includes a fixed barrel, a moving barrel, a cutting device, a grinding plate, and an actuator. The fixed barrel defines a chamber therein and includes a number of inner side surfaces, the inner side surfaces are substantially parallel to a central axis of the fixed barrel. Each of the inner side surfaces defines a holding groove therein for holding a workpiece. The moving barrel is received in the chamber and includes a first side surface and a second side surface, the first side surface and second side surface are substantially parallel to the central axis. The cutting device is fixed on the first side surface. The grinding plate is fixed on the second side surface. The actuator is configured for driving the moving barrel to move towards a workpiece, and rotating the moving barrel.

15 Claims, 6 Drawing Sheets

MULTI-FUNCTIONAL GRINDING APPARATUS

BACKGROUND

1. Technical Field

The present disclosure relates to grinding apparatuses and, particularly, to a multi-functional grinding apparatus.

2. Description of Related Art

Current surface grinding apparatuses generally include a bed with fixture for holding one or more workpieces and a grinder for grinding the workpieces so that surfaces of each of the workpieces are ground into a desired surface. To increase efficiency, a large size bed is required to hold many workpieces at the same time. As such, the grinder can be used to continuously grind the workpieces, or more grinders can be employed to grind the workpiece simultaneously. However, the large size bed reduces space usage efficiency. Furthermore, the workpieces after being ground also need processing by other machining devices, such as water cleaning device, drying device etc. These machining devices also take up a large space.

What is needed, therefore, is a multi-functional grinding apparatus to overcome or at least mitigate the above-described problem.

BRIEF DESCRIPTION OF THE DRAWINGS

Many aspects of the present multi-functional grinding apparatus can be better understood with reference to the accompanying drawings. The components in the drawings are not necessarily drawn to scale, the emphasis instead being placed upon clearly illustrating the principle of the present multi-functional grinding apparatus. In the drawings, all the views are schematic.

DETAILED DESCRIPTION

Embodiments of the present disclosure will now be described in detail below, with reference to the accompanying drawings.

Figure 1:
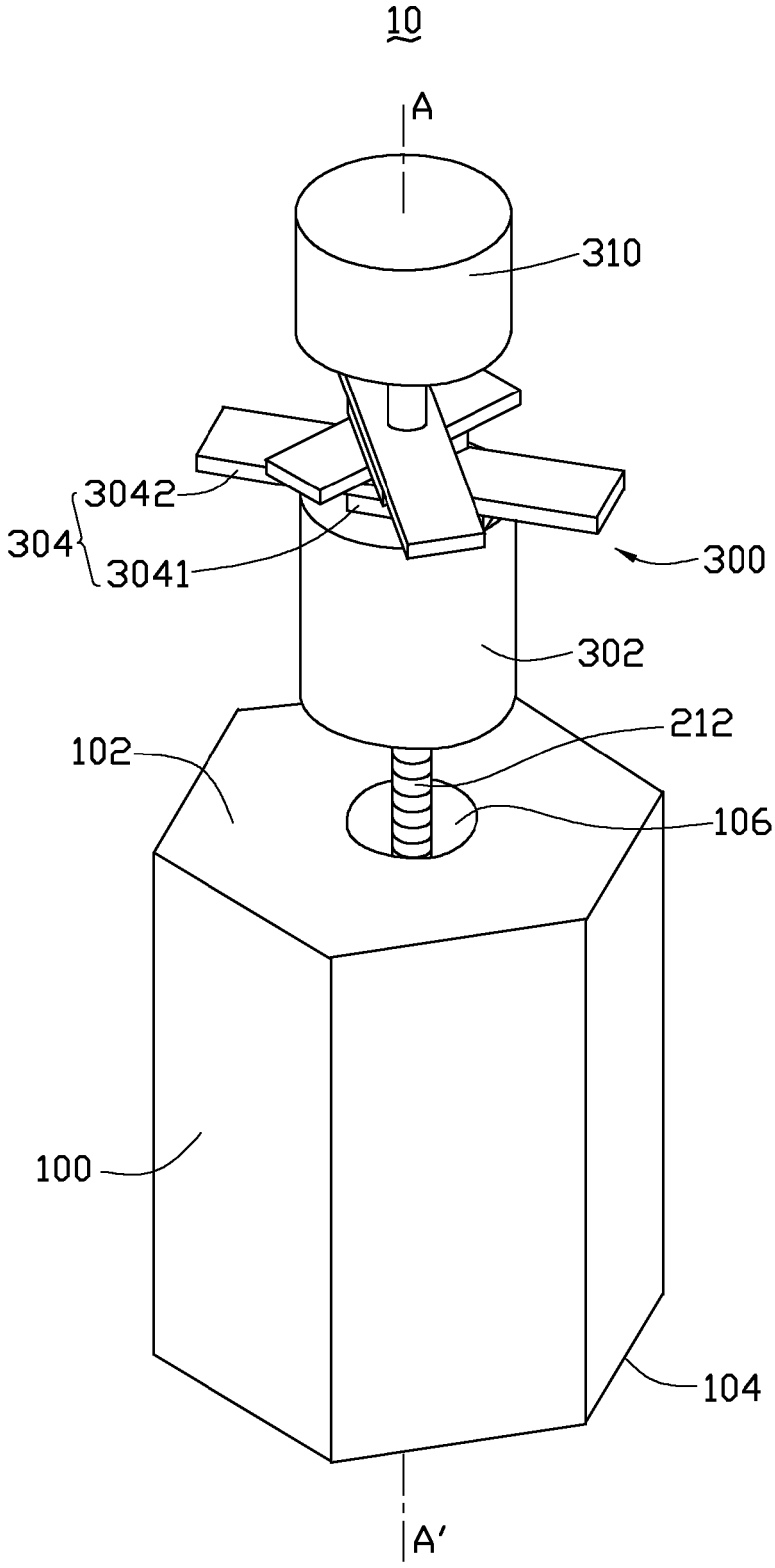
FIG. 1 is an isometric, schematic view of a multi-functional grinding apparatus, according to an exemplary embodiment.
Figure 2:
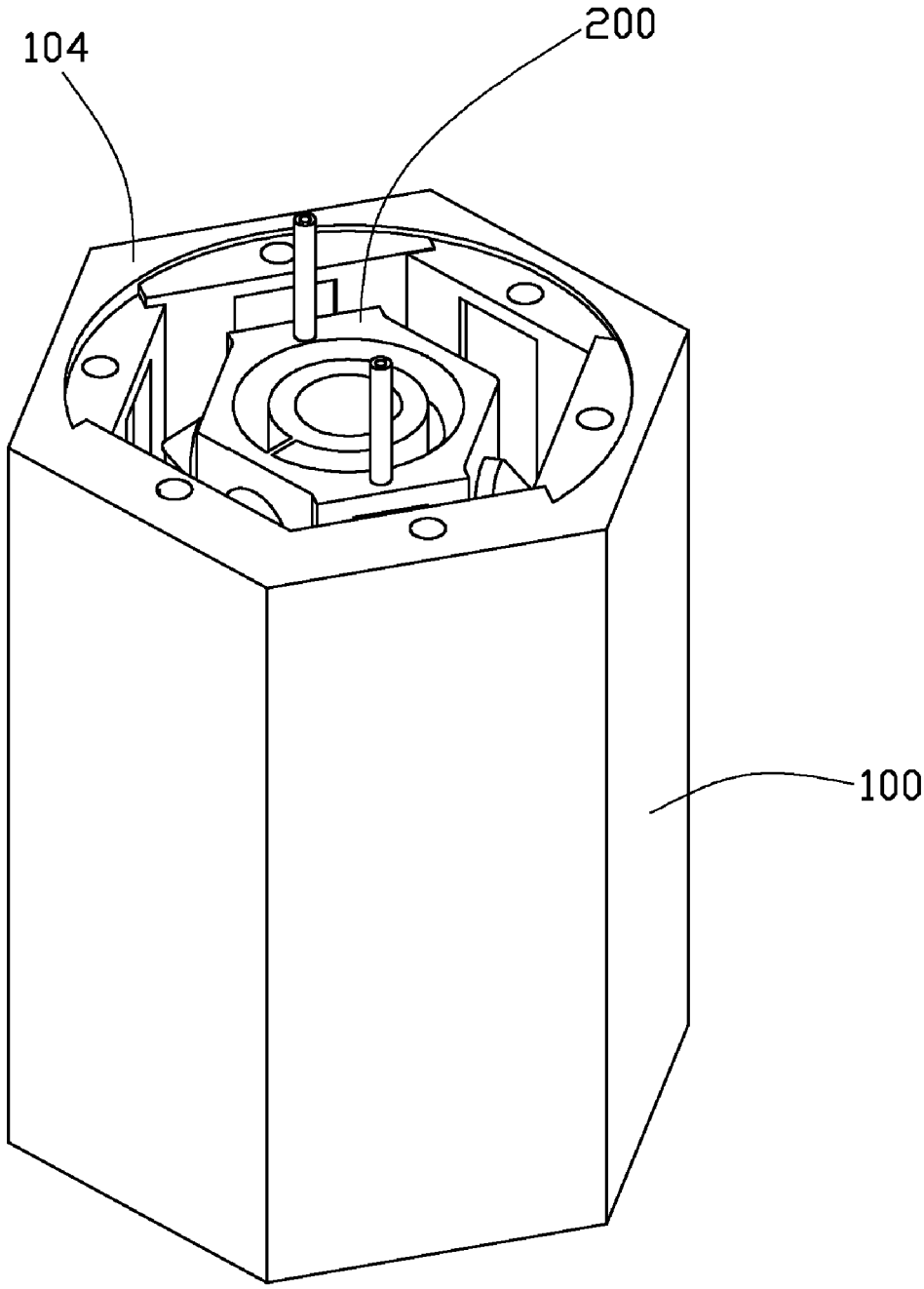
FIG. 2 is an isometric, schematic view of a fixed barrel and a moving barrel of the multi-functional grinding apparatus of FIG. 1.

Referring to FIGS. 1 and 2, shows a multi-functional grinding apparatus 10, according to an exemplary embodiment. The multi-functional grinding apparatus 10 includes a fixed barrel 100, a moving barrel 200, and an actuator 300.

Figure 3:
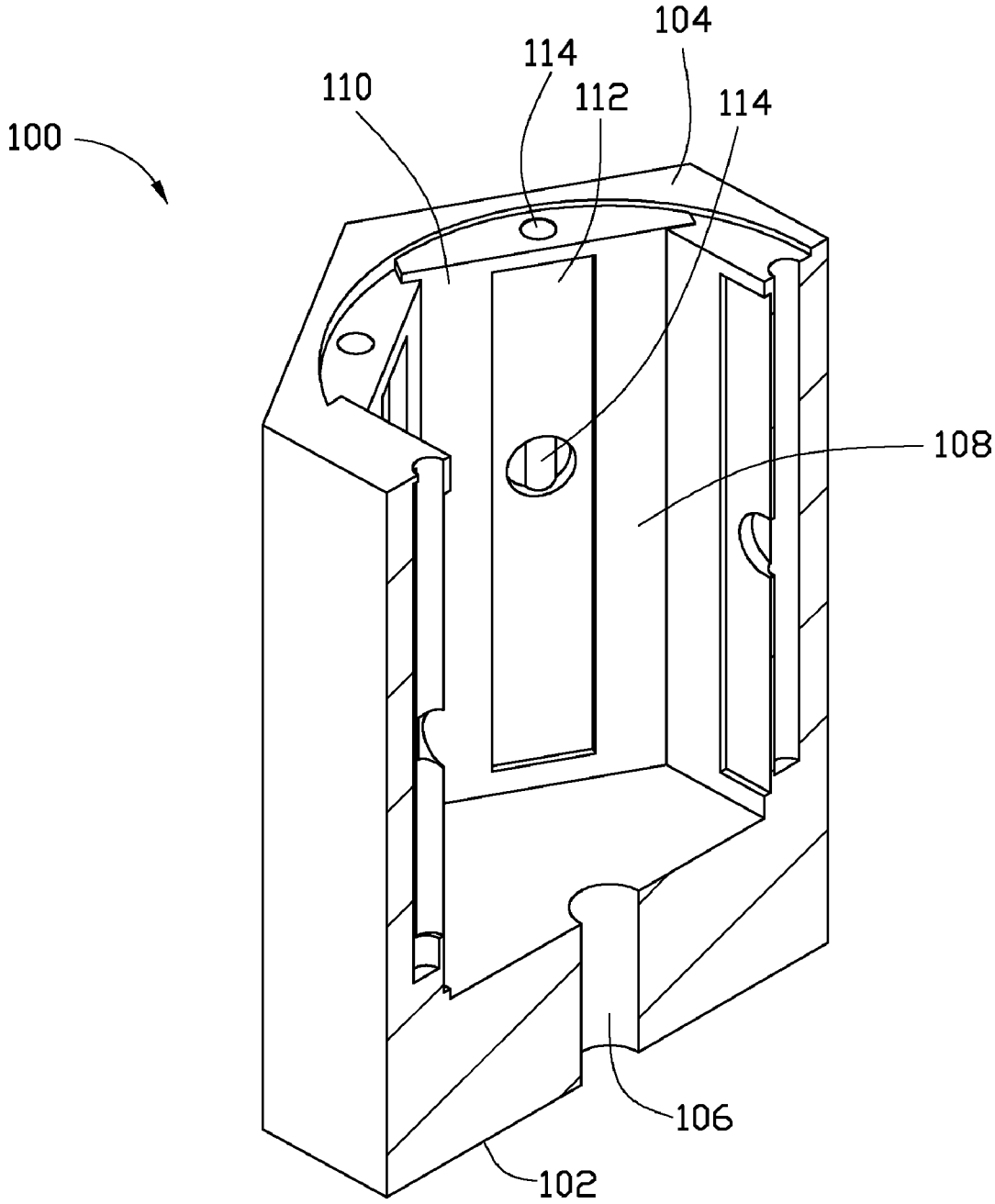
FIG. 3 is an isometric, cross-sectional view of the fixed barrel of the multi-functional grinding apparatus of FIG. 1.

Referring to FIGS. 1 and 3, the fixed barrel 100 is generally a hexagonal prism in shape and is generally symmetrical about a central axis AA' of the fixed barrel 100. The fixed barrel 100 includes a top plate 102 and a bottom plate 104.

The fixed barrel 100 defines a hexagonal prism chamber 108 therein which is symmetrical about the central axis AA'. The hexagonal prism chamber 108 passes through the bottom plate 104 and is bounded by six inner side surfaces 110 of the fixed barrel 100. Each of the inner side surfaces 110 defines a holding groove 112 therein generally at the center thereof. Each of the holding grooves 112 is configured for holding a workpiece therein and is shaped corresponding to the workpiece. In this embodiment, the holding groove 112 is rectangular and arranged so that the length direction thereof is substantially parallel to the central axis AA'. The fixed barrel 100 also defines a number of first suction holes 114. Each of the first suction holes 114 communicates a corresponding holding groove 112 with an external vacuum source (not shown) through the bottom plate 104. As such, after a workpiece is placed in a holding groove 112, the vacuum source is activated to suck the workpiece so that the workpiece is fixedly held by the holding groove 112. The top plate 102 defines a shaft hole 106 therethrough generally at the center thereof.

It is noteworthy, that the hexagonal prism chamber 108 is not limited to this embodiment. To reduce or increase the number of the inner side surfaces 110 for holding less or more workpieces, other types of regular prism chambers can be employed, having less or more inner side surfaces 110.

The holding grooves 112 are also not limited to this embodiment. More holding grooves 112 can be defined in one inner side surface 110 and arranged in other suitable fashions, in other alternative embodiments, in addition, less holding grooves 112 can be employed and defined in certain portions of the inner side surfaces 110, selectively.

It is also noteworthy that the first suction holes 114 for fixedly holding the workpieces in the holding grooves 112 are not limited to this embodiment. In other alternative embodiments, other suitable fastening structures can employee to hold the workpieces in the holding grooves 112 and can omit the first suction holes 114.

Figure 4:
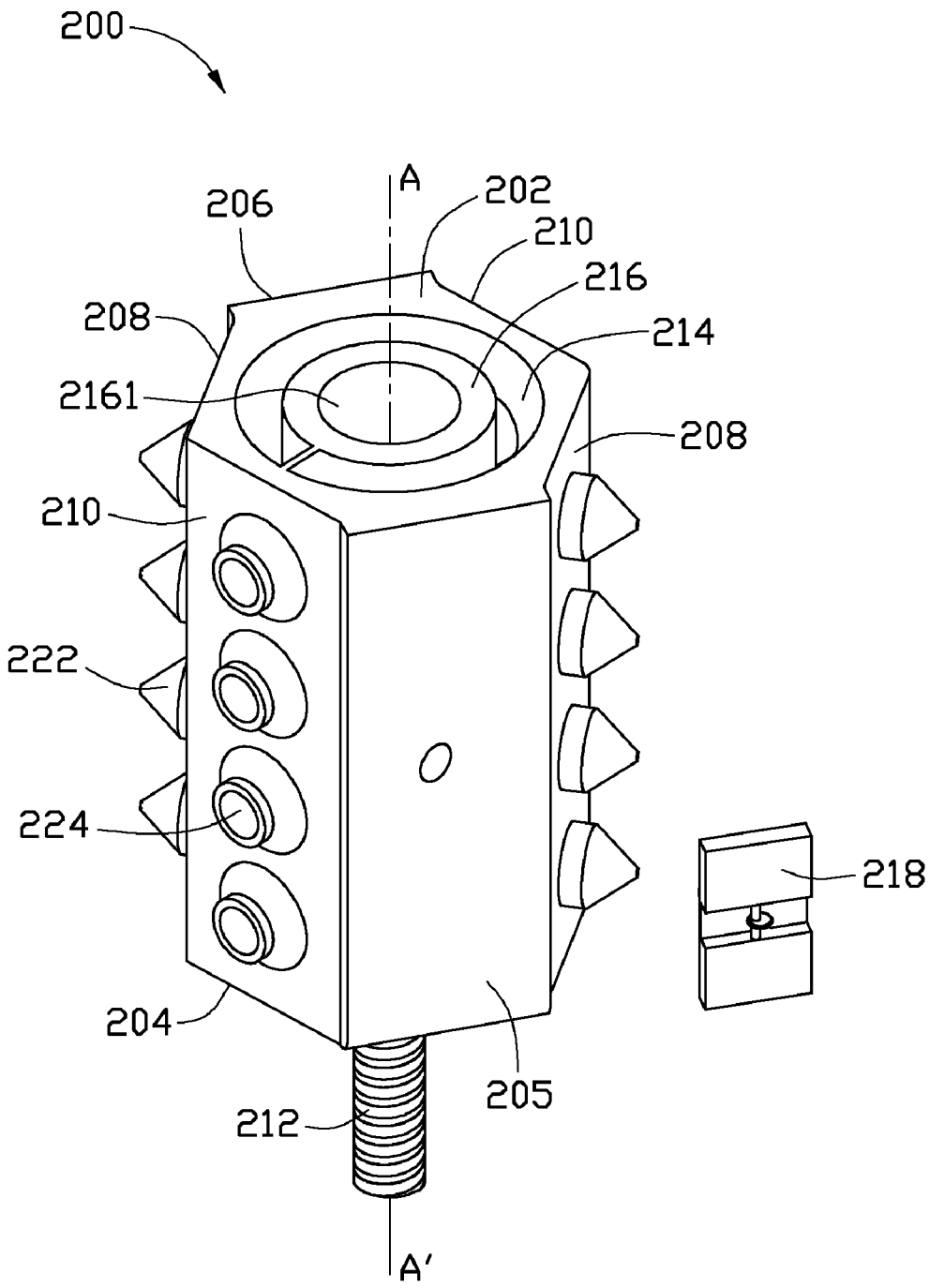
FIGS. 4-5 are partially exploded views of the moving barrel of the multi-functional grinding apparatus of FIG. 1.
Figure 5:
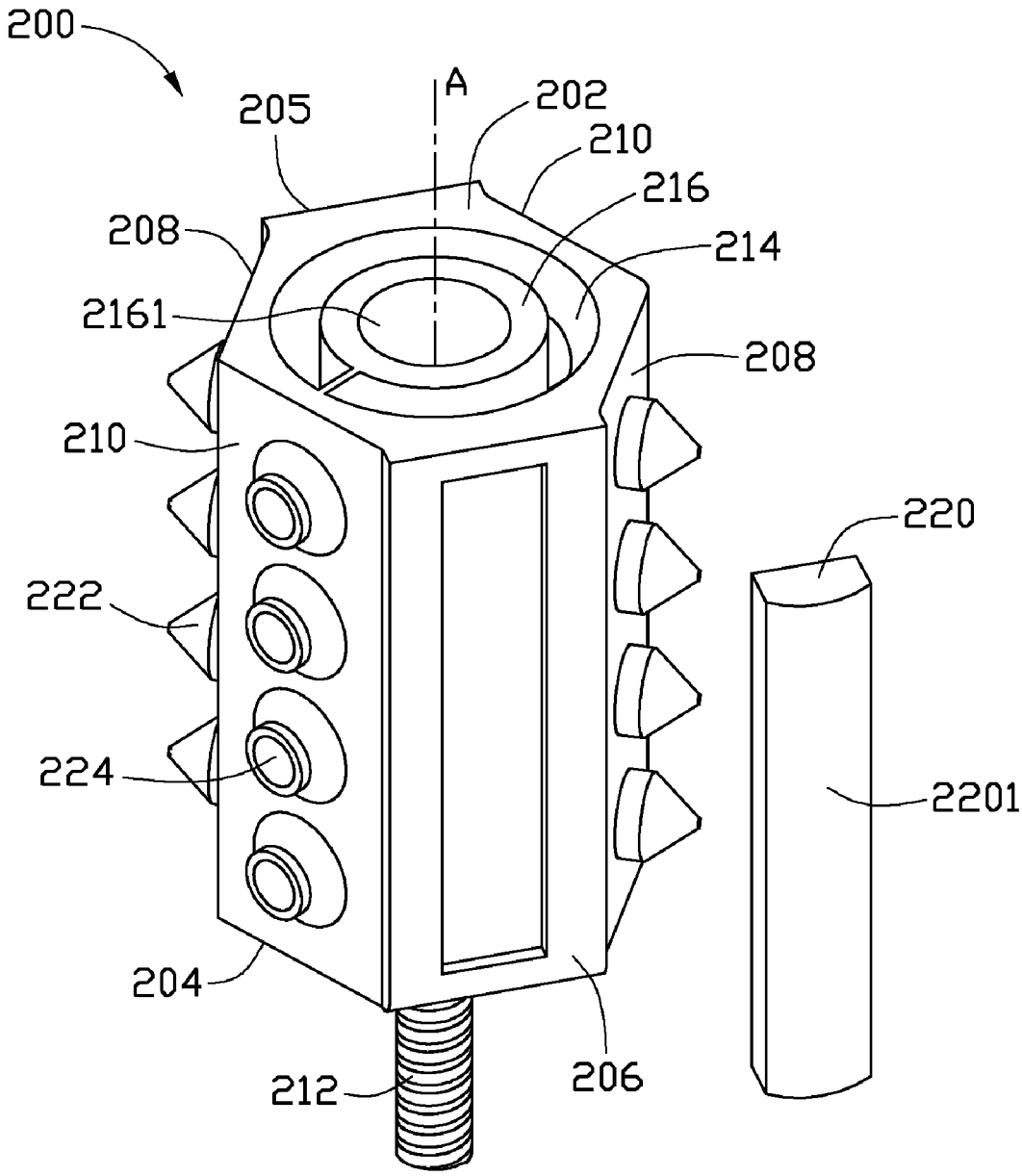

Referring to FIGS. 2 and 4-5, the moving barrel 200 is received within the hexagonal prism chamber 108. The moving barrel 200 is generally a hexagonal prism and includes a top surface 204, a bottom surface 202, a first side surface 205, and a second side surface 206 opposite to the first side surface 205, two opposite third side surfaces 208, and two opposite fourth side surfaces 210. In the present embodiment, the moving barrel 200 includes a cutting device 218, a grinding plate 220, a number of water nozzles 222, and a number of air nozzles 224. The moving barrel 200 further defines a water receiving chamber 214 therein, and includes an air pipe 216 received in the chamber 214.

Figure 6:
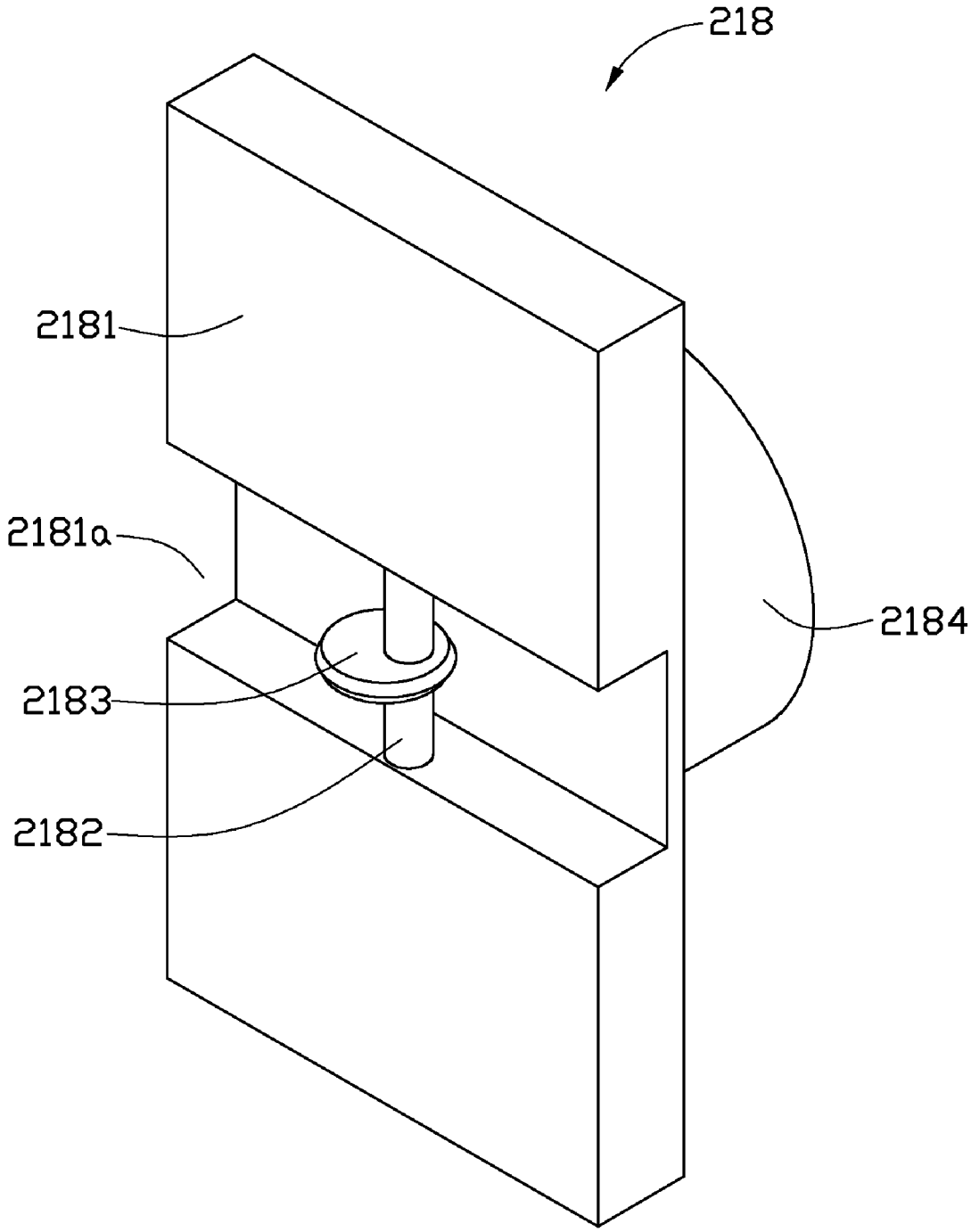
FIG. 6 is a schematic view of a cutting device of the multi-functional grinding apparatus of FIG. 1.

The cutting device 218 is installed on the first side surface 205 of the moving barrel 200. The cutting device 218 is configured for cutting workpieces. Further referring to FIG. 6, in the present embodiment, the cutting device 218 includes a base plate 2181, a rotatable shaft 2182, a cutter 2183, and a fixing portion 2184 for fixing the cutting device 218 to the first side surface 205. The base plate 2181 defines a recessed portion 2181*a*, and the rotatable shaft 2182 is received in the recessed portion 2181*a*. The rotatable shaft 2182 is substantially parallel to the central axis AA' and the cutter 2183 is substantially perpendicular to the rotatable shaft 2182. The cutter 2183 can be received in or protrude out of the recessed portion 2181*a* by rotating the rotatable shaft 2182. The rotatable shaft 2182 can be rotated by a motor (not shown) received in the base plate 2181.

The grinding plate 220 is installed on the second side surface 206 of the moving barrel 200. The grinding plate 220, is spaced from the workpieces when the moving barrel 200 is positioned at the center of the hexagonal prism chamber 108, includes an abrading surface 2201 facing towards the fixed barrel 100.

The water nozzles 222 protrude from the third side surfaces 208. The water nozzles 222 are arranged in a line parallel to the central axis AA' generally at the center of the corresponding third side surface 208. Each of the water nozzles 222 communicates with the water receiving chamber 214.

The air nozzles 224 protrude from the fourth side surfaces 208. The air nozzles 224 are arranged in a line parallel to the central axis AA' generally at the center of the corresponding fourth side surface 210. Each of the air nozzles 224 is communicated with the air pipe 216 which is communicates with an air source (not shown).

The moving barrel 200 also protrudes a shaft 212 from the top surface 204 along the central axis AA' and outside the fixed barrel 100 via the shaft hole 106.

Referring back to FIG. 1, the actuator 300 includes a rotating motor 302, three linear motors 304, and a holder 310. The rotating motor 302 is configured for rotating the shaft 212. The three linear motors 304 are stacked on the rotating motor 302. The angle formed between two adjacent linear motors 304 is about 60 degrees. Each linear motor 304 includes a first moving part 3041 and a second moving part 3042 movable relative to the first moving part 3041.

During cutting process, the cutter 2183 should be rotated by the rotatable shaft 2182 to protrude out of the recessed portion 2181*a*, then, the moving barrel 200 is driven by the three linear motors 304 to move until cutter 2183 contacts one of the workpieces. The workpiece can be cut by the cutter 2183 when the moving barrel 200 being rotated. After the moving barrel 200 being rotated, the depth of the snick formed by the cutter 2183 can be controlled by rotating the rotatable shaft 2182 to control the amount of the cutter protruding out of the recessed portion 2181*a*. During grinding process, the moving barrel 200 is driven by the three linear motors 304 to move until the abrading surface 2201 of the grinding plate 220 contacts one of the workpieces. Then, the moving barrel 200 is driven by the rotating motor 302. As such, the currently ground workpiece is ground by the grinding plate 220. Then, the three linear motors 304 drive the moving barrel 200 towards another workpiece. After all of the workpieces fixed on the fixed barrel are cut or ground, the workpieces can also be cleaned and dried by the water nozzles 222 and the air nozzles 224. The multi-functional grinding apparatus 10 holds more than one workpiece using three dimension space. Workspace is saved and therefore is advantageous.

While certain embodiments have been described and exemplified above, various other embodiments will be apparent to those skilled in the art from the foregoing disclosure. The invention is not limited to the particular embodiments described and exemplified, and the embodiments are capable of considerable variation and modification without departure from the scope and spirit of the appended claims.

What is claimed is:

1. A multi-functional grinding apparatus comprising:

a fixed barrel defining a chamber therein and comprising a plurality of inner side surfaces, the inner side surfaces being substantially parallel to a central axis of the fixed barrel, each of the inner side surfaces defining a holding groove therein for holding a workpiece;

a moving barrel received in the chamber and comprising a first side surface and a second side surface, the first side surface and second side surface being substantially parallel to the central axis;

a cutting device fixed on the first side surface;

a grinding plate fixed on the second side surface; and an actuator configured for driving the moving barrel to move towards a workpiece, and rotating the moving barrel.

2. The multi-functional grinding apparatus as claimed in claim 1, wherein the chamber of the fixed barrel is a hexagonal prism chamber, and the fixed barrel comprises fix inner side surfaces.

3. The multi-functional grinding apparatus as claimed in claim 1, wherein the fixed barrel further defines a plurality of suction holes, each suction hole communicates a corresponding holding groove with a vacuum source.

4. The multi-functional grinding apparatus as claimed in claim 1, wherein the moving barrel further comprises a third side surface being substantially parallel to the central axis, a plurality of water nozzles protrude from the third side surface.

5. The multi-functional grinding apparatus as claimed in claim 4, wherein the plurality of water nozzles are arranged in a line parallel to the central axis generally at the center of the third side surface.

6. The multi-functional grinding apparatus as claimed in claim 4, wherein the moving barrel further defines a water receiving chamber therein, and each of the water nozzles is in communication with the water receiving chamber.

7. The multi-functional grinding apparatus as claimed in claim 1, wherein the moving barrel further comprises a fourth side surface being substantially parallel to the central axis, a plurality of air nozzles protrude from the fourth side surface.

8. The multi-functional grinding apparatus as claimed in claim 7, wherein the plurality of air nozzles are arranged in a line parallel to the central axis generally at the center of the fourth side surface.

9. The multi-functional grinding apparatus as claimed in claim 7, wherein the moving barrel further comprises an air pipe therein, and each of the air nozzles is in communication with the air pipe.

10. The multi-functional grinding apparatus as claimed in claim 1, wherein the moving barrel further defines a water receiving chamber therein, and comprises an air pipe received in the chamber.

11. The multi-functional grinding apparatus as claimed in claim 10, wherein the moving barrel further comprises a third side surface being substantially parallel to the central axis, a plurality of water nozzles protrude from the third side surface, each of the water nozzles is in communication with the water receiving chamber.

12. The multi-functional grinding apparatus as claimed in claim 10, wherein the moving barrel further comprises a fourth side surface being substantially parallel to the central axis, a plurality of air nozzles protrude from the fourth side surface, each of the air nozzles is in communication with the air pipe.

13. The multi-functional grinding apparatus as claimed in claim 1, wherein the cutting device comprises a base plate, a rotatable shaft, a cutter, and a fixing portion fixing the cutting device to the first side surface, the base plate defines a recessed portion, and the rotatable shaft is received in the recessed portion, the rotatable shaft is substantially parallel to the central axis, and the cutter is substantially perpendicular to the rotatable shaft.

14. The multi-functional grinding apparatus as claimed in claim 1, wherein the fixed barrel further comprises a top plate defining a shaft hole therethrough, and the moving barrel comprises a shaft extending out of the fixed barrel via the shaft hole.

15. The multi-functional grinding apparatus as claimed in claim 1, wherein the actuator comprises a rotating motor, three linear motors, and a holder, the rotating motor is configured for rotating the moving barrel, the three linear motors are stacked on the rotating motor for driving the moving barrel to move towards a workpiece.

* * * * *